US007402765B2

(12) United States Patent
Yu

(10) Patent No.: US 7,402,765 B2
(45) Date of Patent: Jul. 22, 2008

(54) FLAT KEY AND THE FRAME SUPPORTING THEREOF

(75) Inventor: Ching-Chiang Yu, Sijhih (TW)

(73) Assignee: Behavior Tech Computer Corp., Taipei County (TW)

( * ) Notice: Subject to any disclaimer, the term of this patent is extended or adjusted under 35 U.S.C. 154(b) by 155 days.

(21) Appl. No.: 11/412,087

(22) Filed: Apr. 27, 2006

(65) Prior Publication Data

US 2006/0266629 A1 Nov. 30, 2006

(30) Foreign Application Priority Data

May 24, 2005 (TW) ..... 94116963 A

(51) Int. Cl.
*H01H 9/26* (2006.01)

(52) U.S. Cl. ..... 200/5 A; 200/341

(58) Field of Classification Search ..... 200/341–344, 200/512–517, 5 A; 400/491–491.2, 490; 361/687, 680, 688
See application file for complete search history.

(56) References Cited

U.S. PATENT DOCUMENTS 6,020,566 A * 2/2000 Tsai ..... 200/344
6,743,993 B1 * 6/2004 Clark et al. ..... 200/314
6,809,273 B2 * 10/2004 Ito et al. ..... 200/5 R
6,812,424 B2 * 11/2004 Miyako ..... 200/511
6,964,532 B1 * 11/2005 Lu ..... 400/490
6,969,815 B1 * 11/2005 Lu ..... 200/345
7,091,434 B2 * 8/2006 Suzuki ..... 200/316
7,138,593 B2 * 11/2006 Toyoda ..... 200/345
7,141,748 B2 * 11/2006 Tanaka et al. ..... 200/310
2003/0188961 A1 * 10/2003 Obara et al. ..... 200/344
2005/0224329 A1 * 10/2005 Milo ..... 200/341
2006/0102456 A1 * 5/2006 Kajiwara et al. ..... 200/313

* cited by examiner

*Primary Examiner*—Michael A Friedhofer
*Assistant Examiner*—Lisa N Klaus
(74) *Attorney, Agent, or Firm*—Muncy, Geissler, Olds & Lowe, PLLC

(57) ABSTRACT

The present invention discloses a frame for use in flat keys. The frame includes a frame body and blocking plates. The frame body holds and supports a keycap, wherein the keycap can be pressed toward the bottom of the frame body. The blocking plates are installed on the frame body and contacted the bottom surface of the keycap, wherein the blocking plates push the keycap toward the top of the frame body to maintain a predetermined distance. The frame of the present invention may be made, in one piece, from plastic such that a slim keyboard equipped with the frames of the present invention has advantages, such as low cost, swift assembly, and high quality of assembly.

18 Claims, 5 Drawing Sheets

FLAT KEY AND THE FRAME SUPPORTING THEREOF

RELATED APPLICATIONS

The present application is based on, and claims priority from, Taiwan Application Serial Number 94116963, filed May 24, 2005, the disclosure of which is hereby incorporated by reference herein in its entirety.

FIELD OF THE INVENTION

The present invention relates to a keyboard for inputting data into a computing device, and more particularly, to a mechanism for use in an individual key of a keyboard.

BACKGROUND OF THE INVENTION

As regards keys used in a conventional slim keyboard, each keycap is held and supported by means of a bridge structure, wherein the bridge structure enables the keycap to travel the key travel distance when pressed down. However, the bridge structure is a scissor structure formed by assembling two independent frames. Obviously, the bridge structure is complex and difficult to assemble. The frames may rupture readily during an assembly process. Upon completion of assembly, it is difficult to detect a ruptured frame used in the bridge structure. As a result, conventional slim keyboards with the bridge structure have drawbacks, namely high manufacturing cost and poor quality control.

In view of the aforesaid drawbacks of the bridge structure adopted by conventional slim keyboards, the inventor of the present invention came up with an innovative idea and invented an improved frame for use in a flat key and to substitute for the aforesaid conventional bridge structure.

SUMMARY OF THE INVENTION

Accordingly, it is a general object of the invention to provide a frame for use in a flat key such that a slim keyboard equipped with the frames of the present invention has advantages, such as low cost, swift assembly, and high quality of assembly.

A related object of the invention is to provide a frame for use in flat keys, wherein the frame comprises a frame body and blocking plates. The frame body holds and supports a keycap, wherein the keycap can be pressed toward the bottom of the frame body. The blocking plates are installed on the frame body and contacted with the bottom surface of the keycap, wherein, given the blocking plate, the keycap is pushed toward the top of the frame body to maintain the predetermined key travel distance.

Briefly and in accordance with the foregoing objects, the present invention provides a flat key which comprises a frame, a keycap and an elastic element of the present invention.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

DETAILED DESCRIPTION OF THE INVENTION

Figure 1:
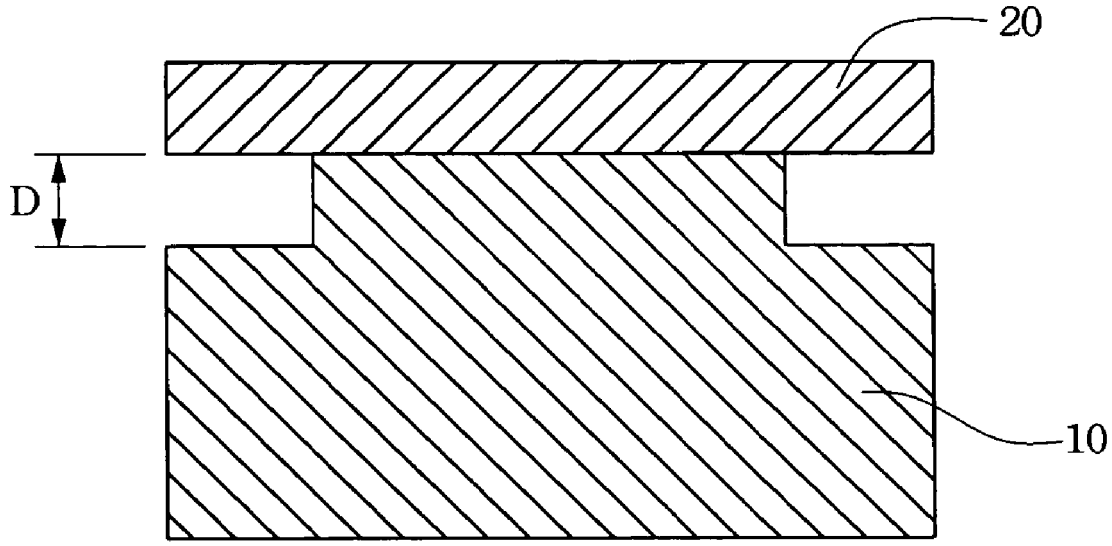
FIG. 1 is a schematic diagram showing the structure of a frame for use in flat keys of the present invention.

FIG. 1 is a schematic diagram showing the structure of a frame for use in flat keys of the present invention. Intended for use in flat keys of the present invention, the frame 10 is an important component for manufacturing a slim keyboard. The frame 10 of the present invention is made, in one piece, from plastic and thereby has advantages, such as low manufacturing cost and ease of assembly. As shown in FIG. 1, the frame 10 has two functions: first, the frame 10 holds and supports a keycap 20 which can be pressed downward; second, the frame 10 enables the keycap 20 to be pushed upward to maintain a predetermined key travel distance D. Upon completion of assembly of the frame 10 and the keycap 20, in a normal state the keycap 20 is pushed upward by the frame 10 and thus between the keycap 20 and the frame 10 there is an operating distance (i.e. the predetermined key travel distance D, hereinafter referred to as "predetermined distance D") which allows for the downward press. The operating distance, which accounts for a reduction in overall height of a flat key, decreases the height of the flat key by at least the predetermined distance D. Once the keycap 20 moves downward under a key-pressing force and travels the predetermined distance D, the bottom surface of the keycap 20 is in contact with the top surface of the frame 10 fully.

Figure 2:
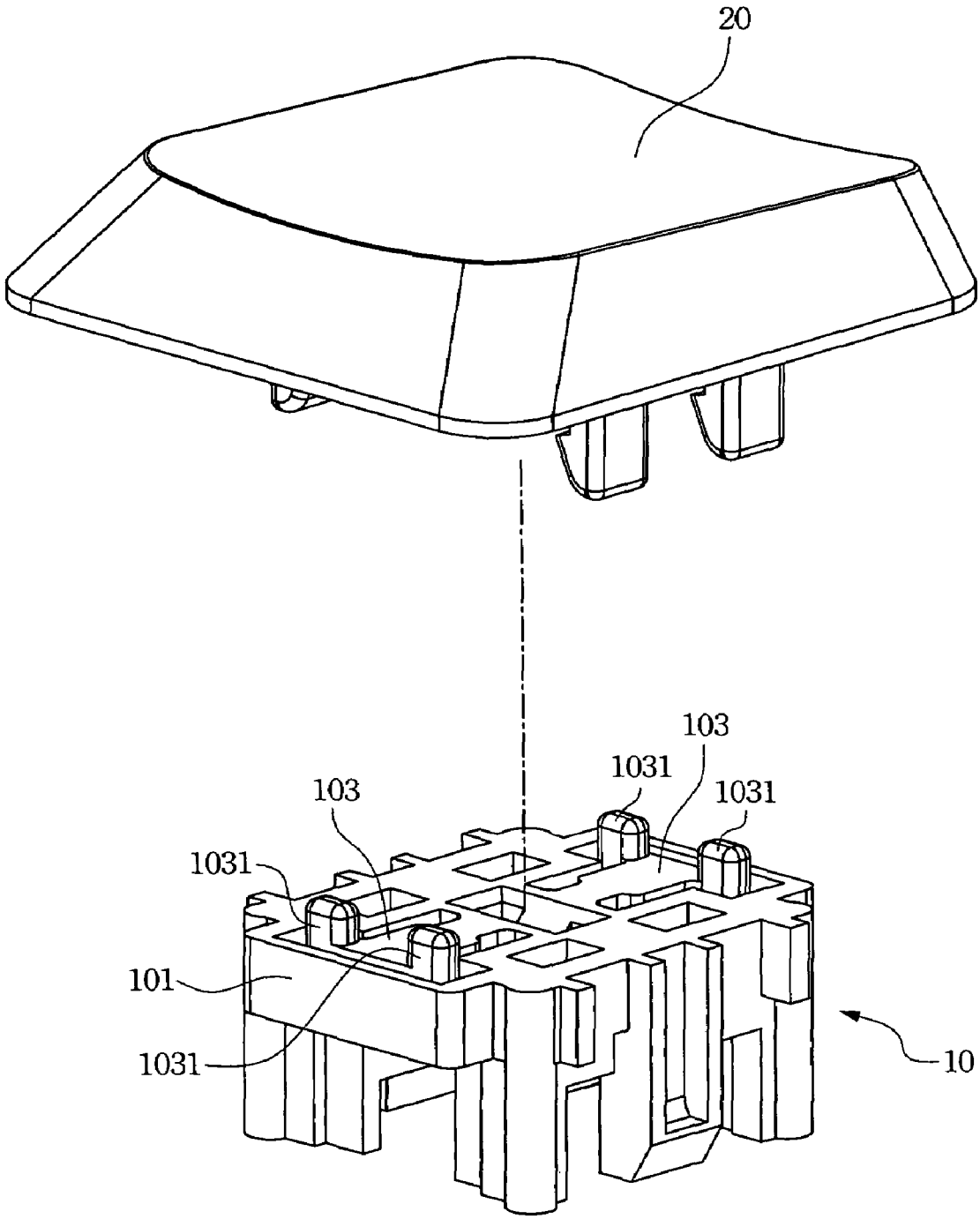
FIG. 2 is an elevational view of an embodiment of the frame and the keycap shown in FIG. 1.
Figure 3:
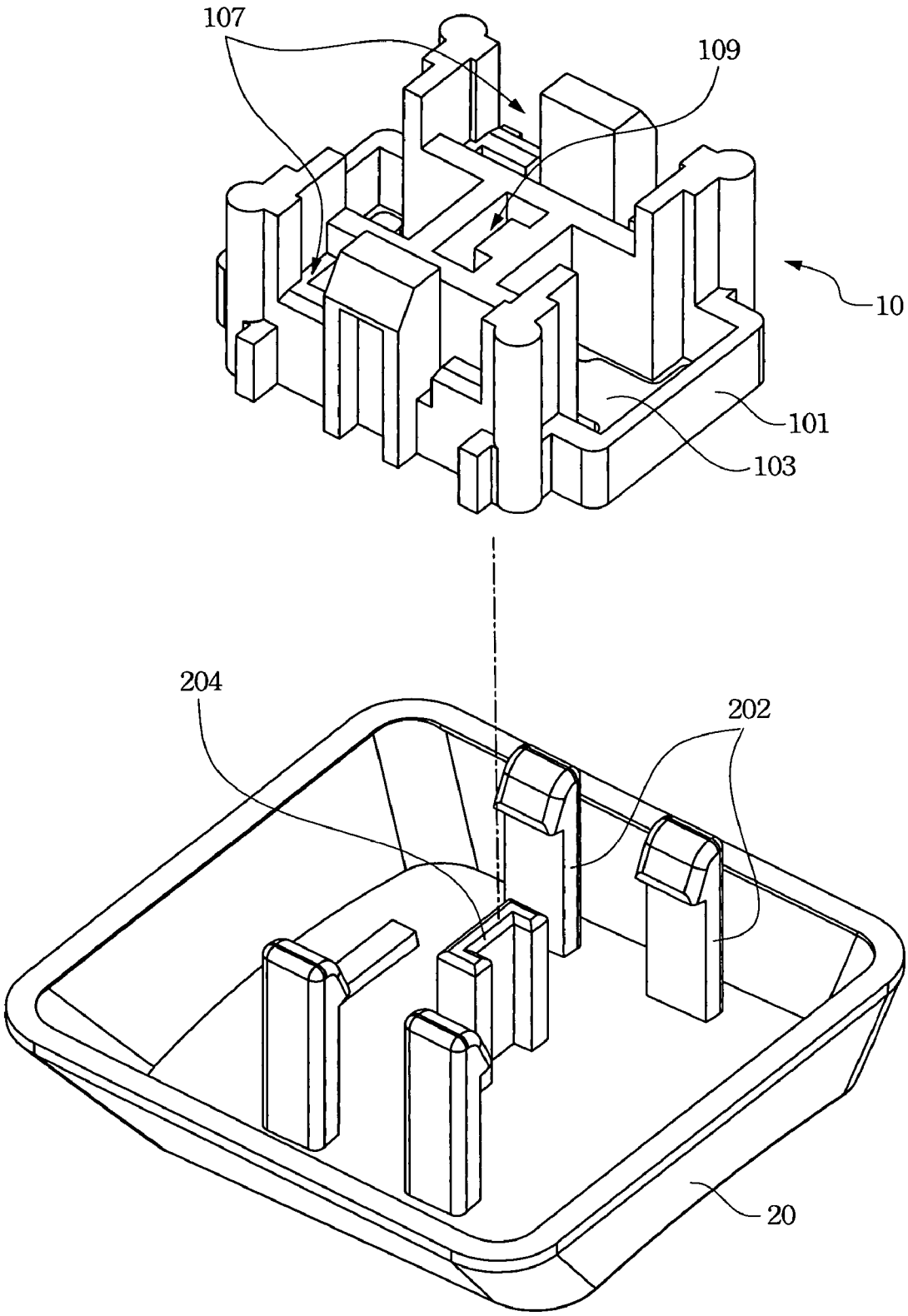
FIG. 3 is a bottom, elevational view of the frame and the keycap shown in FIG. 2.

FIG. 2 is an elevational view of preferred embodiment of the frame 10 and the keycap 20 shown in FIG. 1, whereas FIG. 3 is a bottom, elevational view of the frame 10 and the keycap 20 shown in FIG. 2. The frame 10 comprises a frame body 101 and blocking plates 103. The frame body 101 holds and supports the keycap 20; the structure of the frame body 101 enables the keycap 20 to travel the key travel distance when pressed down. To enables the keycap 20 to be pushed upward to maintain the predetermined distance D, the present invention has the blocking plates 103 and its protruding members 1031 installed on the top of the frame 10. The blocking plates 103 can be in contact with the bottom surface of the keycap 20, and can push the keycap 20 upward to maintain a predetermined distance D by the protruding members 1031. Two blocking plates 103 are installed on the top of the frame body 101, opposite to each other(or symmetrical), such that not only can the keycap 20 be pushed upward under an evenly applied pushing force, but also the top surface of the keycap 20 is positioned horizontally.

In FIG. 2, each of the blocking plates 103 comprises one or more protruding members 1031. The protruding members 1031 are installed on the top surface of the blocking plate 103. The height of the protruding members 1031 is equal to the predetermined distance D. The protruding members 1031 is contact with the bottom surface of the keycap 20, and in consequence the keycap 20 is evenly pushed by the protruding members 1031 to maintain the predetermined distance D. As the keycap 20 moves downward gradually under the downward key-pressing force, the blocking plates 103 are gradually bent downward into the frame body 101; the blocking plates 103 are totally bent into the frame body 101 (and the protruding members 1031 are at the top surface level of the frame body 101) as soon as the blocking plates 103 travel the predetermined distance D. As a result, the flat key looks shorter, and the height of the flat key is decreased by at least the predetermined distance D. In this preferred embodiment, the number of the protruding members 1031 can be two, and the protruding members 1031 are installed on the top surface of the blocking plates 103, opposite to each other.

In FIG. 3, the keycap 20 has four dampers 202 for fitting into four slots 107 of the frame body 101 so as to secure the keycap 20 to the frame body 101 after they are assembled. However, the keycap 20 still can be moved up and down due to dimensions of slots 107. Further, the keycap 20 has a guide member 204 for inserting into a through hole 109 of the frame body 101 so as to maintain the keycap 20 to be straight ups and downs.

Figure 4:
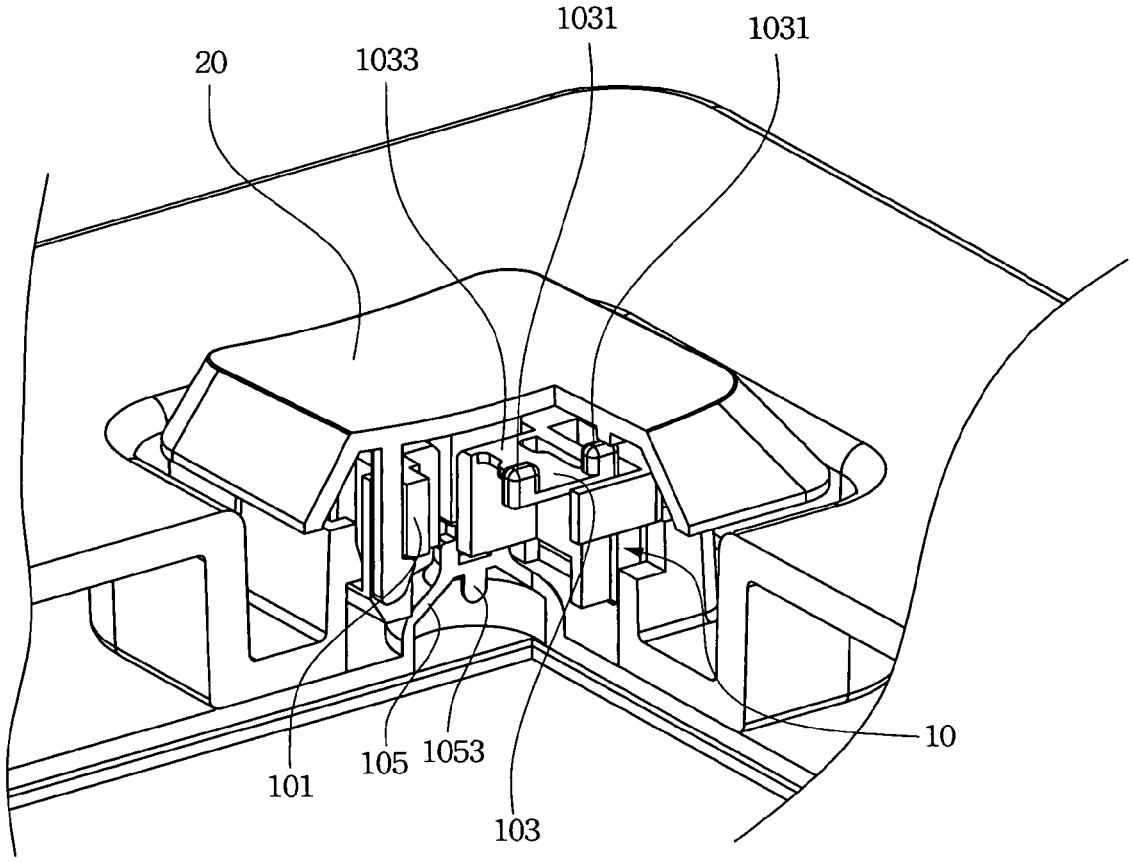
FIG. 4 is an elevational view in section of a flat key equipped with a frame.
Figure 5:
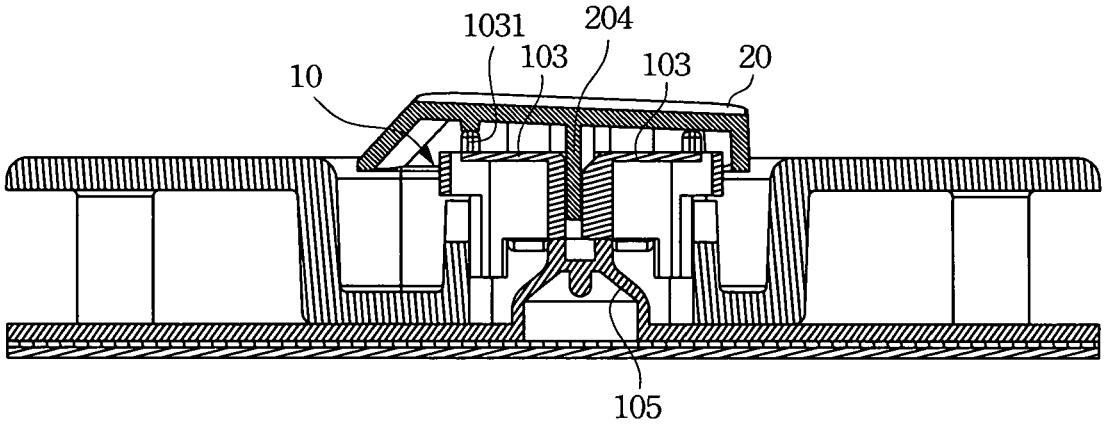
FIG. 5 is a cross-sectional view of a flat key equipped with a frame.

FIG. 4 is an elevational view in section of a flat key equipped with a frame, whereas FIG. 5 is a cross-sectional view of a flat key equipped with a frame of the present invention. The blocking plates 103 of the present invention have a preload function, wherein the protruding members 1031 preload an elastic element 105 by its guide member 204; as a result, a user using a flat key equipped with the frame 10 of the present invention strongly perceives that a downward press of a key is staged. Basically, the resilient blocking plate 103, which is part of the top surface of the frame body 101, extends from the frame body 101, and a connection portion 1033 between the frame body 101 and the blocking plates 103 is constricted such that the blocking plate 103 can be deformed (or bent) easily and then recovered. In addition, a trigger member 1053 of the elastic element 105 (when a downward press is applied) is in contact with a piezoelectric device on a circuit board (not illustrated in drawings) to execute inputting function. Both the blocking plate 103 and the elastic element 105 can be deformed when a downward press is applied and then recovered.

The frame of the present invention is made in one piece, without a drawback of conventional flat keys, that is, the complicated bridge structure assembly process of conventional flat keys. In addition, it is simple to manufacture the frame of the present invention with a forming machine. Accordingly, the present invention brings a slim keyboard plenty advantages, such as low cost, swift assembly, and high quality of assembly.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

What is claimed is:

1. A frame for use in flat keys, said frame comprising:

a frame body, holding and supporting a keycap; and blocking plates, being part of a top surface of said frame body and being contact with a bottom surface of said keycap, wherein said blocking plates support the keycap a predetermined distance from the top surface of said frame body, and are bent downward under a down press and recovered without the down press, and wherein said blocking plate comprises protruding members disposed on the top surface, height of each of said protruding members identical to said predetermined distance, said protruding members in contact with the bottom surface of said keycap.

2. The frame of claim 1, wherein the number of said blocking plates is two, said two blocking plates arc disposed symmetrically on top of said frame body.

3. The frame of claim 1, wherein the number of said protruding members installed on each of said blocking plates is two, said two protruding members are disposed symmetrically.

4. The frame of claim 1, wherein said frame is made from plastic.

5. The frame of claim 1, wherein said frame is made in one piece.

6. The frame of claim 1, wherein said blocking plates are gradually bent downward into said frame body when said keycap is pressed toward said frame body.

7. The frame of claim 1, wherein said blocking plates preload an elastic element.

8. A flat key, comprising:

a keycap; and a frame, including:

a frame body, holding and supporting the keycap; and blocking plates, being part of a top surface of said frame body and being contact with a bottom surface of said keycap, wherein said blocking plates support the keycap a predetermined distance from the top surface of said frame body, and are bent downward under a down press and recovered without the down press, wherein each of said blocking plates comprises protruding members, said protruding members installed on a top surface of said two blocking plates, height of each of said protruding members identical to the predetermined distance, said protruding members in contact with the bottom surface of said keycap; and an elastic member installed under said frame and being in contact with said bottom surface of said frame.

9. The flat key of claim 8, wherein the number of said blocking plates is two, said two blocking plates are disposed symmetrically on top of said frame body.

10. The flat key of claim 8, wherein the number of said protruding members installed on each of said blocking plates is two, said two protruding members are disposed symmetrically.

11. The flat key of claim 8, wherein said frame is made from plastic.

12. The flat key of claim 8, wherein said frame is made in one piece.

13. The flat key of claim 8, wherein said blocking plates are gradually bent downward into said frame body when said keycap is pressed toward said frame body.

14. The flat key of claim 8, wherein said blocking plates preload said elastic element.

15. The flat key of claim 8, wherein said keycap includes a guide member to fit into a through hole of the frame body so as to maintain said keycap to be straight moved up and down.

16. The flat key of claim 15, wherein the guide member preload said elastic element.

17. The flat key of claim 8, wherein each of said blocking plates includes a constricted connection portion to link with the top surface of said frame body.

18. The flat key of claim 8, wherein said keycap includes clampers to fasten on the frame body.

* * * * *